United States Patent [19]

Sanders

[11] Patent Number: 4,535,921

[45] Date of Patent: Aug. 20, 1985

[54] IRONING BOARD CADDY

[76] Inventor: Mildred P. Sanders, 304 Melrose Dr., Jackson, Miss. 39211

[21] Appl. No.: 601,201

[22] Filed: Apr. 17, 1984

[51] Int. Cl.[3] ..... D06F 81/10

[52] U.S. Cl. ..... 223/106; 248/311.2; 38/106; 38/137; 220/18; 224/252; 24/510

[58] Field of Search ..... 223/106–109 R; 248/231.5, 311.2, 314, 225.31, 231.7, 231.8, 231.2, 231.3, 313, 316.1, 316.5; 2/185 R, 199, 10, 422; 38/104, 106, 142, 137, 140; 108/28; 220/18; 224/194, 240, 252, 253, 251; 24/67.7, 499, 500, 507, 509, 510, 511; D7/70

[56] References Cited

U.S. PATENT DOCUMENTS

| | | | |
|---|---|---|---|
| 768,364 | 8/1904 | Hines | 220/18 X |
| 1,483,592 | 2/1924 | Pelstring | 248/311.2 X |
| 1,963,977 | 6/1934 | Flagstad | 38/137 |
| 2,278,401 | 3/1942 | Micari | 224/194 X |
| 2,618,419 | 11/1952 | Vanish | 224/252 |
| 2,884,722 | 5/1959 | Lehrman | 38/104 X |
| 3,121,388 | 2/1964 | Benson | 24/510 X |
| 3,159,894 | 12/1964 | Haug | 24/499 |
| 3,248,765 | 5/1966 | Achabal et al. | 248/311.2 X |
| 3,417,443 | 12/1968 | Gentilucci | 24/499 |
| 3,990,617 | 11/1976 | Carter | 224/251 |
| 4,154,010 | 5/1979 | Evans | 248/311.2 X |

FOREIGN PATENT DOCUMENTS

| | | | |
|---|---|---|---|
| 649006 | 6/1964 | Belgium | 223/108 |

*Primary Examiner*—Werner H. Schroeder
*Assistant Examiner*—Andrew M. Falik
*Attorney, Agent, or Firm*—John E. Benoit

[57] ABSTRACT

A caddy for attachment to an ironing board for holding various implements as well as spray containers for starch or the like comprising a container having open multiple compartments and one upstanding wall which abuts against the outer face of the depending flange of the ironing board, and a spring biased clip pivotally attached to the back side of the upstanding wall with the upper end of the clip being biased against the inner wall of said flange whereby the caddy depends from said flange adjacent said ironing board. A pin cushion is secured to a portion of the outer face of the compartment and a loop for holding scissors is pivotally secured to another portion of the outer face of the compartment.

13 Claims, 3 Drawing Figures

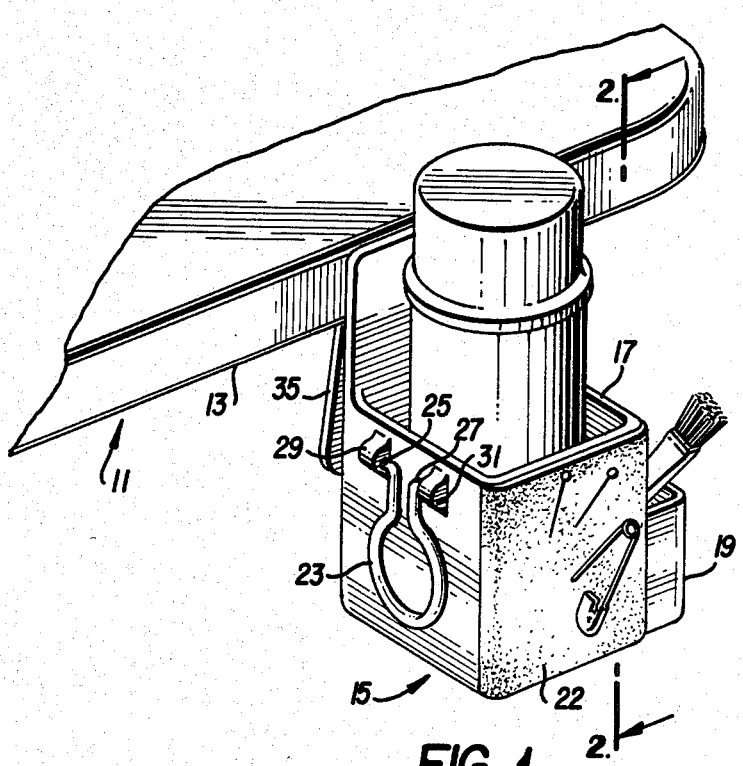
FIG. 1
FIG. 3
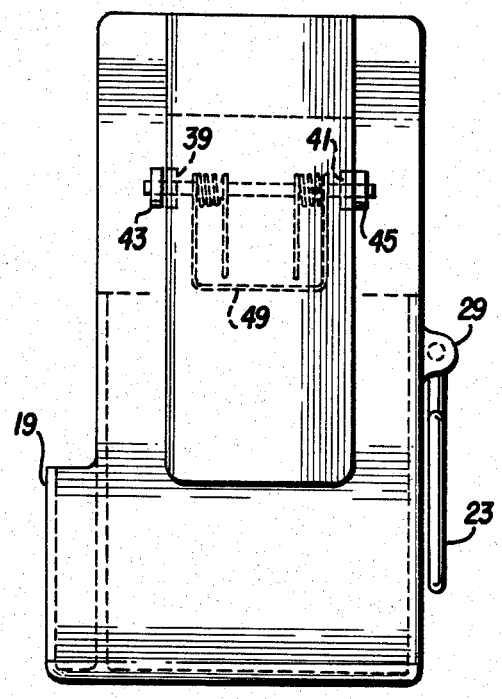
FIG. 2
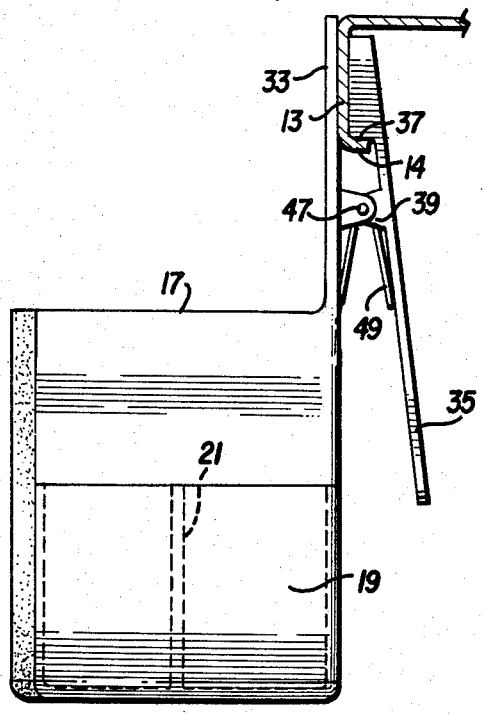

IRONING BOARD CADDY

This invention relates to an accessory for an ironing board and more particularly to an ironing board caddy for holding various implements, cans and the like which are used during the ironing process.

Under normal usage, the average person ironing at an ironing board tends to use the surface adjacent the flat end of the ironing board for placing pieces of equipment such as scissors, pins and even spray starch cans or the like for easy convenience while ironing. This causes that end of the ironing board to become crowded and creates a hazard to the user when all of the devices used in the ironing process are placed thereon. The hot iron is also usually tilted on end and placed near the same end of the ironing board so that the person using the ironing board is always in danger of receiving a burn when reaching for any such device which may rest near the hot iron. Additionally, there is a tendency to strike the cans and knock them from the ironing board.

Many devices have been created in an attempt to avoid the above problems. In most cases, these devices are in the form of an attachment to the ironing board itself. U.S. Pat. No. 3,568,970 issued Mar. 9, 1971 and U.S. Pat. No. 4,154,010 issued May 15, 1979 both show devices for retaining articles used during ironing. The former shows a clamp having a circular ring for holding a can such as a can of starch. The latter discloses an attachment having several compartments and a hangar for holding various other implements that may be used. In each case, these attachments are removable but when in use are still basically on the surface of the ironing board itself. Although they may tend to pevent a person from striking the items and causing them to fall, they still do not eliminate the fact that useable space on the ironing board is eliminated. Additionally, the items are still in the vicinity of the iron which still creates a possible danger of burn. Further, placing an aerosol starch can near a hot iron presents a possible explosion hazard.

U.S. Pat. No. 3,913,878 discloses an ironing board attachment for holding a can of starch or the like which fits over the forward or rounded end of the ironing board. While this presents a means for holding the can of starch in a position away from the normal iron position, it completely eliminates the possible use of the rounded end of the ironing board which is, in itself, designed for particular ironing procedures.

U.S. Pat. No. 3,055,129 issued Sept. 25, 1962 proposes to provide an attachment for an ironing board which extends outwardly beyond the ironing board and, thus, increases the length of the ironing board. In most instances this is not desirable because of the extra space required by using the device. Additionally, it still maintains the implements and the cans adjacent the resting place of the hot iron and does not avoid the above discussed danger of burn.

U.S. Pat. No. 2,884,722 discloses an ironing board cover which has a pouch at one end so as to provide a place to store the equipment. This pouch requires that the user search through the pouch to locate the desired equipment. Additionally, it is located at the end of the ironing board which also requires that one reach past the area where the resting iron is normally placed.

The present invention eliminates the problems which are inherent with the above discussed devices.

Additionally, an object of the present invention is to provide a caddy which hangs adjacent to but below the ironing board along the side thereof so as to be immediately available to the user.

Another object of the invention is to provide a caddy which contains multiple compartments designed for holding spray containers, such as starch cans or the like, easily locatable implements and scissors which are conveniently within reach and removable therefrom.

Another object of the invention is to provide a caddy which is easily attached for use and removed for storage by a clip means to the downwardly extending flange of the standard metal ironing board.

Another object of this invention is to free the ironing board fo total utilization of work space.

These and other objects of the invention will become apparent from the following description when taken in connection with the drawings.

BRIEF DESCRIPTION OF THE DRAWINGS

FIG. 1 is a perspective view of the caddy of the present invention attached to an ironing board;

FIG. 2 is a view taken along the lines 2—2 of FIG. 1; and

FIG. 3 is a rear view of the caddy of FIG. 1, removed from the ironing board.

BRIEF SUMMARY OF THE INVENTION

The present invention provides a caddy for easy attachment to an ironing board so as to provide a device for holding various implements as well as spray containers, or the like. The caddy comprises a container having at least one open compartment, and preferably multiple compartments, and one wall of which is upstanding so that it may abut against the outer face of the depending flange of the ironing board. A spring biased clip is pivotally attached to the back of the upstanding wall, with the upper end of the clip being biased against the inner wall of the flange whereby the segmented compartment is held in depending relationship to the ironing board from the flange. A pin cushion may be added to the outer wall of the container as well as a pivotally supported loop for carrying scissors. The caddy is preferably attached to the side of the ironing board near the flat end so that it is always immediately available at the side of the user of the ironing board.

DETAILED DESCRIPTION OF THE PREFERRED EMBODIMENT

Turning now to the drawings, there is shown a metal ironing board 11 including depending flange 13 with a lip 14 extending toward the center of the ironing board lip. This is standard structure for metal ironing boards. A compartmented container 15 having a large compartment 17 and, as shown in the present drawings, two smaller compartments 19 extending from the side of the larger compartment. As can be seen in FIG. 2, the smaller compartment is divided into two compartments by dividing wall 21.

Also provided on one side of the caddy is pin cushion 22, preferably of a material such as cork, which is secured to the main compartment by means such as adhesive. On another side of the container, there is pivotally secured a loop 23 which terminates in fingers 25 and 27 which are inserted into ears 29 and 31 extending from compartment 17.

As illustrated in FIG. 1, the larger compartment is designed particularly for cans such as spray containers including starch and the like, and securely holds such containers in an available position adjacent to the person using the ironing board while preventing accidental displacement of the can from the board. The pin cushion is self-explanatory and the smaller compartments may hold anyting from marking pencils, brushes and hem gauges or any of the standard type of implements that are used during use of the ironing board. The loop 23 conveniently stores a pair of scissors with the points downward as can be obviously envisioned. Such storage provides an obvious additional safety feature. Such scissors are not shown in order to simplify the drawings.

Turning now more specifically to FIGS. 2 and 3, it can be seen that upstanding wall 33 is substantially flat so as to bear against flange 13. Clip 35, having a shoulder 37 at the terminal end thereof is pivotally secured to wall 33 by means of tabs 39 and 41 on the clip and tabs 43 and 45 extending from wall 33 with pivot pin 47 extending through all tabs. Additionally, a standard torsion spring 49 of the clipboard type is supported by pin 47 and biases clip 35 in the direction of wall 33.

As will now be obvious, by merely compressing clip 35 the device may be passed over flange 13, and when clip 35 is released the entire caddy is secured to the flange of the ironing board under the pressure of spring 49. Lip 14 of flange 13 further insures that the caddy will not drop form the ironing board due to the added precaution of shoulder 37 of clip 35. This structure further stabilizes the caddy in a position on the ironing board as shown.

It is preferred that the basic unit, including compartments 17 and 19, upstanding wall 33, ears 29 and 31 and tabs 43 and 45 be molded as a unit. Additionally, it is preferably that loop 23 be of a plastic semirigid material so that the fingers 25 and 27 may be pressed together so as to be insertable in ears 29 and 31. Clip 35 is also molded separately and includes tabs 39 and 41 so that the device may be sold in kit form and easily assembled or may be assembled and sold as a complete unit.

As will now be obvious, the present invention provides a caddy which is easily attached to and removed from an ironing board and which, while remaining in easily accessible position also is removed from the surface of the ironing board. This not only prevents possibilities of contact with the iron when reaching for any equipment in the caddy, but also prevents the inadvertent contact with the spray container causing it to fall to the floor.

The above description and drawings are illustrative only since the various components could be modified as to size and shape extent without departing from the present invention, the scope of which is to be limited only by the following claims.

I claim:

1. A caddy for attachment to an ironing board having a downwardly extending peripheral flange with an inwardly extending lip, said caddy comprising at least one substantially rigid compartment open at its upper end;

a substantially flat wall forming part of, and extending upwardly from said compartment for abutting the outer face of said flange; and a spring biased clip pivotally secured to the outer face of said wall with its upper end opposite said upwardly extending wall for abutting the inner face of said flange whereby said upwardly extending wall and clip, when secured to said flange, support said caddy below the edge of said ironing board.

2. The caddy of claim 1 having a plurality of open compartments of different sizes.

3. The caddy of claim 1 further comprising pin cushion means secured to a portion of the outer face of said compartment.

4. The caddy of claim 1 further conprising a loop hinged to a portion of the outer face of said compartment for insertion and removal of implements.

5. The caddy of claim 1 wherein said compartment including said upwardly extending wall is an integral molded structure.

6. The caddy of claim 1 further comprising a shoulder on the inner upper end of said clip for resting upon said lip by said flange.

7. The caddy of claim 1 wherein said additional compartment is rectangular and further comprising at least one compartment secured to the outer face of one side of said compartment;

pin cushion means secured to the outer face of a second side of said compartment; and a semi-rigid loop hinged to the outer face of a third side of said compartment.

8. A caddy for attachment to an ironing board having a downwardly extending peripheral flange with an inwardly extending lip, said caddy conprising at least one substantially rigid compartment open at its upper end;

a substantially flat wall forming part of said compartment;

releasable clamping means; and means for attaching said clamping means to the side of said flat wall opposite to said compartment whereby said compartment can be removably secured to the flange of the ironing board.

9. The caddy of claim 8 having a plurality of open compartments of different sizes.

10. The caddy of claim 8 further comprising pin cushion means secured to a portion of the outer face of said compartment.

11. The caddy of claim 8 further comprising a loop hinged to a portion of the outer face of said compartment for insertion and removal of implements.

12. The caddy of claim 8 wherein said compartment including said upwardly extending wall is an integral molded structure.

13. The caddy of claim 8 wherein said compartment is rectangular and further comprising at least one additional compartment secured to the outer face of one side of said compartment;

pin cushion means secured to the outer face of a second side of said compartment; and a semi-rigid loop hinged to the outer face of a third side of said compartment.

* * * * *